United States Patent [19]

Maruyama

[11] 4,280,450

[45] Jul. 28, 1981

[54] LIQUID HEATING APPARATUS

[76] Inventor: Noboru Maruyama, No. 26-14, Shirasagi 2-chome, Nakano-ku, Tokyo, Japan

[21] Appl. No.: 88,487

[22] Filed: Oct. 26, 1979

[30] Foreign Application Priority Data

May 15, 1979 [JP] Japan ..... 54-59399

[51] Int. Cl.[3] ..... F22B 5/00

[52] U.S. Cl. ..... 122/17; 122/121; 122/122

[58] Field of Search ..... 126/391, 350 R; 122/17, 122/13 R, 135 A, 135 F, 155 R, 157, 158, 159, 160, 162, 166 R, 178, 16, 121, 122, 182 S, 182 T, 182 R

[56] References Cited

U.S. PATENT DOCUMENTS

| | | | |
|---|---|---|---|
| 657,794 | 9/1900 | Shaw | 122/135 A |
| 1,245,488 | 11/1917 | Millis | 122/135 A |
| 3,490,420 | 1/1970 | Kramer | 122/17 |

*Primary Examiner*—Carroll B. Dority, Jr.
*Assistant Examiner*—R. J. Marett
*Attorney, Agent, or Firm*—Blanchard, Flynn, Thiel, Boutell & Tanis

[57] ABSTRACT

A liquid heating apparatus according to the present invention comprises a cylindrical outer shell, an inner shell consisting of a cylindrical body whose upper and lower portions are respectively provided with an enlarged flue chamber having a cross-sectional area remarkably larger than that of said cylindrical body, said inner shell being disposed within said outer shell so as to provide a space forming a water jacket between the two shells, a fire chamber formed by closing said cylindrical body at above said lower enlarged flue chamber, an insert hole for burner which penetrates said inner and outer shells and opens into said fire chamber, a rising heated gas chamber which is disposed above said fire chamber so as to communicate with it as well as said upper enlarged flue chamber, a falling heated gas space formed by intercommunicating said upper and lower enlarged flue chambers by means of plural smoke pipes penetrating the water jacket formed in between said outer shell and inner shell, and a flue outlet provided for said lower enlarged flue chamber.

5 Claims, 9 Drawing Figures

LIQUID HEATING APPARATUS

BACKGROUND OF THE INVENTION

The present invention relates to a liquid heating apparatus for use in a boiler and the like utilizing an up/-down flow process with respect to heated gas.

The so-called 'up/down flow process' herein means a method wherein a heated gas is made to flow in an inverted U-shaped gas passage so as to effect heat exchange between the flowing heated gas and a liquid surrounding said gas passage, whereby the temperature of the heated gas is gradually lowered with its progress and the downward movement of the gas in the falling portion of the gas passage is facilitated to enhance the draft power of the passage, smooth the discharge of carbon dioxide as well as the supply of air and raise the combustion efficiency. This process will first be explained.

Referring to FIG. 1 in the appended drawings, the draft power P generating within the inverted U-shaped gas passage is expressed by the following equation:

$$P=H\cdot\Delta r \quad (1)$$

wherein,

P: draft power ($Kg/m^2$);

H: height of gas passage (m);

$\Delta r$: specific gravity of heated gas ($Kg/m^3$).

When the equation (1) is altered by applying Tu and Td, it goes as follows:

$$P=H\cdot C(1/Td-1/Tu) \quad (2)$$

wherein,

Tu: average temperature within the rising gas passage (°K);

Td: average temperature within the falling gas passage (°K);

C: constant (Kg °K/$m^3$).

As is evident from the equation (2), the more heat exchange is effected in the falling gas space, the greater becomes the value of 1/Td relative to the value of 1/Tu, and consequently the value of draft power P becomes greater. It will be understood from the above description that the draft power is closely related to the difference of density between the rising gas passage and the falling gas passage, and the greater is the difference of temperature between the rising heated gas chamber and the falling heated gas space, the greater is the draft power that is generated.

To cite an instance of the liquid heating apparatus utilizing the above described up/down flow process hitherto known, there has been proposed an apparatus such as shown in FIG. 2 by the present inventor. This previously proposed apparatus is of a structure such that an inner shell 6 is installed within an outer shell 5 by leaving a required space between the two so as to form a falling heated gas chamber 9 between them as illustrated in FIG. 2, an outside water jacket 2 is formed along the outside of this falling heated gas chamber 9, an inside water jacket 7 which communicates with the outside water jacket 2 at the upper and lower parts thereof is installed inside the falling heated gas chamber 9, a rising heated gas chamber 8 is installed within the inner shell, both chambers 8 and 9 intercommunicate by way of a flue 12 disposed at their upper parts, a flue gas exit 10 is provided at the lower part of one side of the falling heated gas chamber 9, and a water entrance 11 is provided at the lower part of one side of the outside water jacket 2 while a hot water faucet 13 is provided at the upper part of the same. In this FIG. 2, the reference numeral 14 denotes a water pipe connecting the inside water jacket 7 to the outside water jacket 2, and 3 denotes a burner for heating.

A liquid heating apparatus of such construction can admittedly generate a great draft power for the reason stated in the foregoing, but it is defective in that the water in the water jacket 2 would evaporate to increase the concentration of calcium carbonate, magnesium carbonate, etc. dissolved therein, causing deposition of such substances on the wall portion of the inner shell right above the fire chamber 17 as scale 4 in such a state as illustrated in FIG. 2. And as a result, heat exchange at this portion cannot be effected sufficiently and then crack by superheating is apt to be brought. Besides, inasmuch as the upper edge portion 15 of the water jacket 7 and the lower edge portion 16 of the falling heated gas chamber 9 are almost horizontally directed and hamper the rising of water, air separated from water becomes bubbles which attach to both edge portions 15 and 16 to cause a phenomenon of oxygen concentration cell, and corrosion is apt to take place at this portion. Moreover, inasmuch as heat exchange is efficiently effected, the low-temperature exhaust gas causes deposition of dews in the vicinity of the flue outlet 10 and the stay of the thus deposited dews results in troubles such as corrosion of the portion.

As described above, the conventional liquid heating apparatuses have been defective in that combustion loss, corrosion, etc. due to various factors would take place in every part thereof, whereby the apparatus as a whole is damaged to be dangerous for operation or unfit for prolonged use.

SUMMARY OF THE INVENTION

The object of the present invention is to provide a liquid heating apparatus which can eliminate the aforedescribed defects of the conventional liquid heating apparatuses.

Another object of the present invention is to provide a liquid heating apparatus which comprises an outer shell, an inner shell installed within said outer shell and a water jacket formed in between the two shells, said inner shell containing a cylindrical body and upper and lower enlarged flue chambers communicating with said cylindrical body, and is so designed that a fire chamber disposed within said cylindrical body has its surrounding wall as well as bottom wall built of a refractory material, said upper and lower enlarged flue chambers intercommunicate by way of plural smoke pipes which vertically penetrate said water jacket, and the periphery of the lower part of the cylindrical body in the surroundings of the fire chamber is surrounded with smoke pipes and flue chambers for exhaust gas having reduced temperature, whereby occurrence of high-temperature wall portions can be checked, generation of scales can be prevented, and convection current of water, to wit, ascending of water in between the smoke pipes and the water jacket and descending of water in between the smoke pipes and the wall of outer shell, is positively generated and, as a result, any scales generated are washed away by said current and prevented from depositing on the wall of inner shelf, the wall of enlarged flue chambers and the wall of smoke pipes having a relatively high temperature, so that occurrence of crack by superheating attributable to deposition of scales on these walls can be effectively prevented.

A further object of the present invention is to provide a liquid heating apparatus which is so designed that the configuration of the enlarged flue chambers disposed above and below the fire chamber is part-spherical respectively and accordingly the heated liquid ascends smoothly along their surfaces without being obstructed and air separated from the liquid never attaches to their surroundings in the form of bubbles, thereby making the apparatus free from partial corrosion ascribable to concentration cell.

A still further object of the present invention is to provide a liquid heating apparatus which is so designed that a heat radiating plate is installed on the lower face of the bottom wall of the fire chamber bordering on the top of the lower enlarged flue chamber so as to heat the exhaust gas which descends within the smoke pipes, contains dew-generating elements as a result of the lowering of temperature and is to be discharged into the lower enlarged flue chamber and dissipate said dew-generating elements by the radiant heat emitted from said plate, whereby generation of dews can be checked, and as for the dews generated at the time when, for instance, combustion is discontinued, they can be discharged through a drain pipe provided in the center of the bottom of the lower enlarged flue chamber, whereby occurrence of corrosion due to stay of dews in the smoke pipes as well as the lower enlarged flue chamber can be prevented.

DETAILED DESCRIPTION OF THE INVENTION

Figure 1:
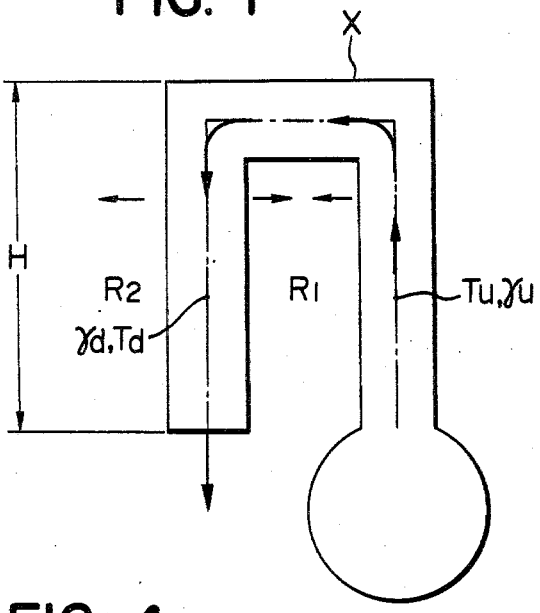
FIG. 1 is a diagram illustrative of the up/down flow process with respect to the heated gas.
Figure 4:
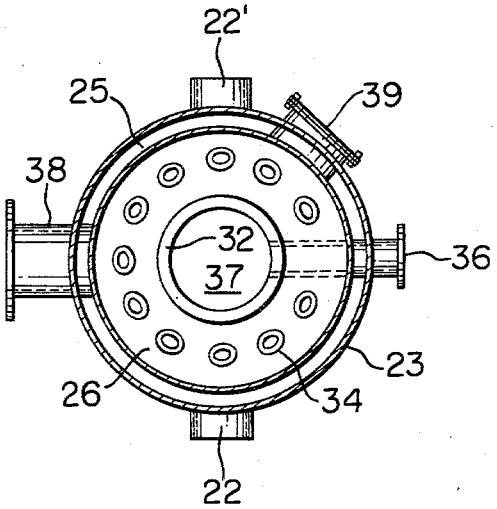
FIG. 4 is a cross-sectional view taken along the line IV—IV in FIG. 3.
Figure 2:
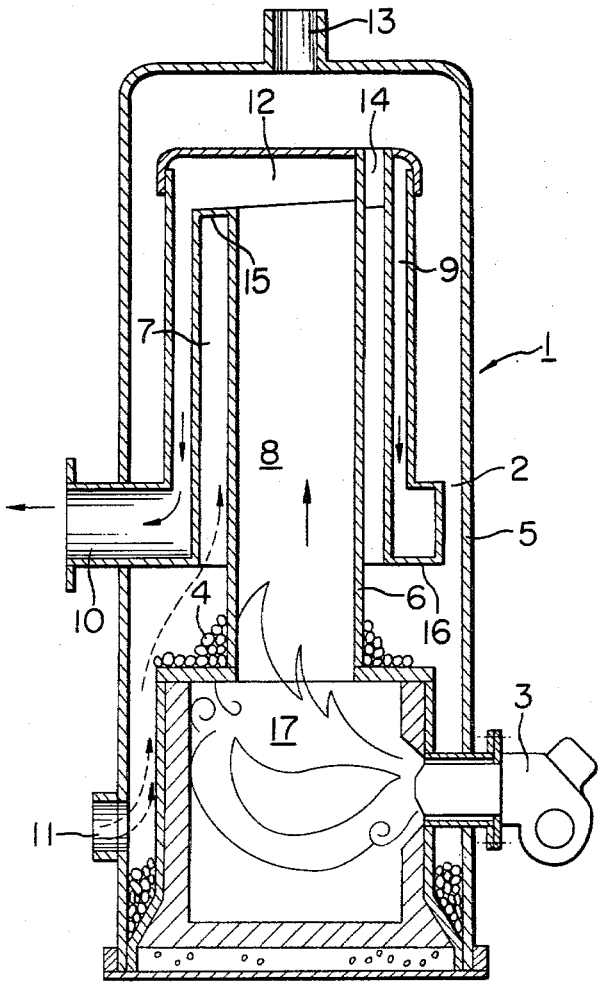
FIG. 2 is a longitudinal sectional view of a conventional liquid heating apparatus.
Figure 3:
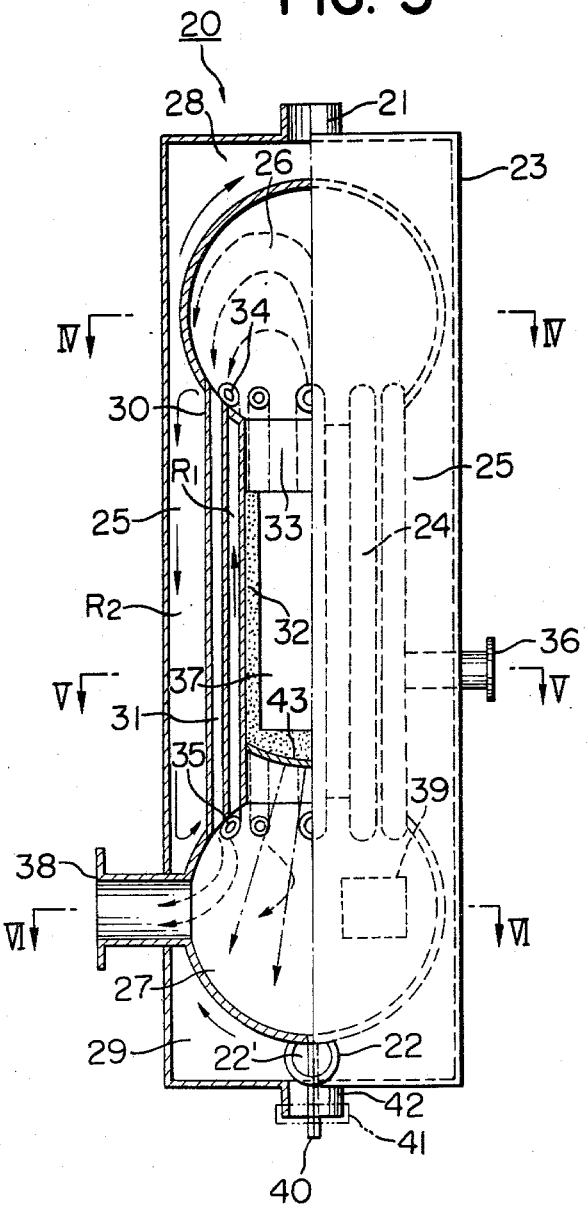
FIG. 3 is a diagram illustrative of a liquid heating apparatus according to the present invention, in which the left side of the center-line shows the inner parts of the apparatus as partially cut off.
Figure 5:
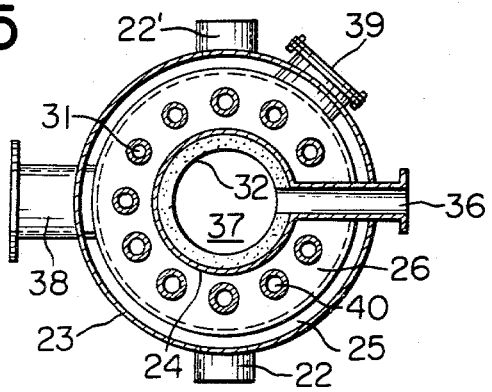
FIG. 5 is a cross-sectional view taken along the line V—V in FIG. 3.
Figure 6:
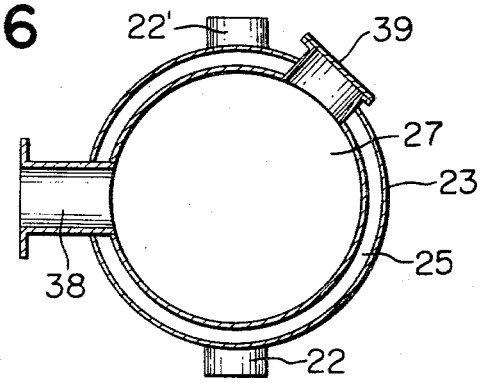
FIG. 6 is a cross-sectional view taken along the line VI—VI in FIG. 3.

Referring to FIGS. 3 through 5, the reference numeral 20 denotes a liquid heating apparatus as a whole. This liquid heating apparatus 20 is provided with a cylindrical outer shell 23 equipped with a hot water outlet 21 disposed on the upper part thereof and a pair of water inlets and/or outlets 22 and 22' disposed on the lower part thereof. Within this outer shell 23 is disposed an inner shell 24 by leaving a space between the two shells so as to form an intermediate water jacket 25 defined by their walls. This inner shell 24 consists of a cylindrical body whose upper and lower ends take a hollow spherical shape respectively, and these hollow spherical portions, namely, the upper and lower enlarged flue chambers 26 and 27, have a diameter larger than that of the cylindrical body. In between the outer shell 23 and the upper and lower enlarged flue chambers 26 and 27 are formed an upper water jacket 28 and a lower water jacket 29 respectively.

The upper and lower enlarged flue chambers 26 and 27 intercommunicate by way of plural smoke pipes 30 arranged within the intermediate water jacket 25 formed in between the outer shell 23 and the inner shell 24, and these smoke pipes 30 constitute a falling heated gas space 31. Above the lower enlarged flue chamber 27 within the inner shell 24, there is provided a fire chamber 27 formed of a cylindrical refractory material 32, said fire chamber having its lower part closed and its upper part left open. This fire chamber 37 and the upper enlarged flue chamber 26 intercommunicate through a rising heated gas chamber 33. Within the fire chamber 37 below said rising heated gas chamber 33 is provided an insert hole for burner 36 penetrating the inner and outer shells 23 and 24 for the purpose of inserting therein an appropriate combustor not shown in the drawings.

In this connection, although the above described embodiment represents an apparatus designed to intercommunicate the upper and lower enlarged flue chambers 26 and 27 by means of beeline smoke pipes 30, the way of intercommunicating them is not limited to the foregoing, that is, it also will do to intercommunicate them upon configuring the vicinities of the inlet portion as well as the outlet portion of the smoke pipes 30 into curves. Further, although the upper and lower enlarged flue chambers 26 and 27 in this embodiment represent spherical ones, the configuration of these chambers is not limited to the foregoing, that is, these chambers can of course be of any other appropriate configuration.

The lower enlarged flue chamber 27 is provided with a flue outlet 38 and a manhole 39 which are transversely disposed and a drain tube 40 which is vertically disposed. Also, a drain pipe 42 equipped with a detachable cover 41 is disposed at the bottom of the outer shell 23 in order to discharge the sludge deposited in the inner and outer shells 23 and 24. The drain tube 40 penetrates the drain pipe 42 and the cover 41.

Further, a pair of water inlets and/or outlets 22 and 22' disposed in the lower part of the outer shell 23 may be used alternately while blocking either of the two, or it will do to replace them with a single inlet or outlet, depending on the site of the apparatus. Plural smoke pipes 30 illustrated in the drawings are disposed concentrically with the inner shell 24, but the way of disposition thereof is not limited to the foregoing. That is, these pipes 30 may be disposed eccentrically or zigzag relative to the inner shell 24; even in these cases, it is ideal to set the interspace C of smoke pipes 30 to be practically equal to or less than the diameter of said pipe 30.

Next, how to operate the above described apparatus will be explained.

A liquid-to-be-heated is first filled in the intermediate water jacket 25 defined by the outer shell 23 and the inner shell 24 and the upper and lower water jackets 28 and 29 by way of the water inlet 22, and then combustion is effected by means of an appropriate combustor (not shown in the drawings) inserted in the insert hole for burner 36 provided in the fire chamber 37. The heated gas ascends from the fire chamber 37 disposed within the inner shell 24 along the inside of the rising heated gas chamber 33, enters the upper enlarged flue chamber 26 disposed above the upper part of the fire chamber 37, runs against the inner wall of the upper part of said flue chamber 26, has its direction of flow rectified along said inner wall, and descends within the falling heated gas space defined by plural smoke pipes 30 from the smoke pipe inlet 34. Then, the heated gas enters the lower enlarged flue chamber 27 through the smoke pipe outlet 35 disposed above it, is heated by the radiant heat from the bottom plate 43 to become dry air, and is thereafter discharged to the outside of the apparatus through the flue outlet 38 of the lower enlarged flue chamber 27.

The heated gas performs heat exchange with water within the water jackets 25, 28 and 29 efficiently on the wall surface of the inner shell 24, smoke pipes 30 and upper and lower enlarged flue chambers 26 and 27 during its circular movement, and heats the liquid within the water jackets 25, 28 and 29 to cause convective rising of the water within the water jacket 45 formed in between the smoke pipes 30 and the inner shell 24 due to the sudden rising flow as in boiling and cause convective falling of the water within the water jacket 46 formed in between the smoke pipes 30 and the outer shell 23, whereby the liquid within the apparatus is uniformly heated during its natural convection thus effected and hot water can be obtained quickly.

On this occasion, the high-temperature heated gas blown up from the fire chamber 37 runs against the top wall of the upper enlarged flue chamber 26 having a large area, changes its direction of flow thereat, performs heat exchange with the surrounding water, and further performs heat exchange within the smoke pipes 30 while descending, whereby it turns into a gas having a sufficiently low temperature at the smoke pipe outlet 35 and is discharged into the lower enlarged flue chamber 27. Inasmuch as the lower enlarged flue chamber 27 is thus filled with a low-temperature gas and the fire chamber 37 is disposed higher than this enlarged flue chamber 27, the lower part of the fire chambers 37 is, unlike the conventional apparatuses, free from conduction of a high-temperature gas and, therefore, there is little fear of its bringing about a high-temperature wall portion that will induce deposition of scales.

Figure 8:
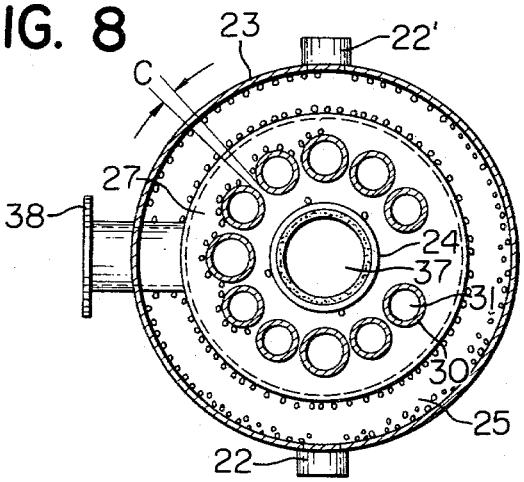
FIG. 8 is an enlarged cross-sectional view taken along the line VIII—VIII in FIG. 7.
Figure 7:
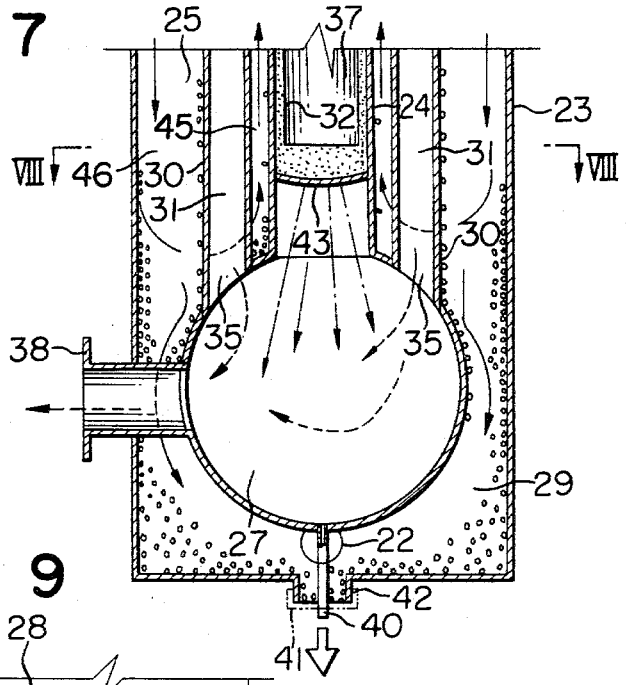
FIG. 7 is an enlarged longitudinal sectional view of the lower part of the apparatus shown in FIG. 3.
Figure 9:
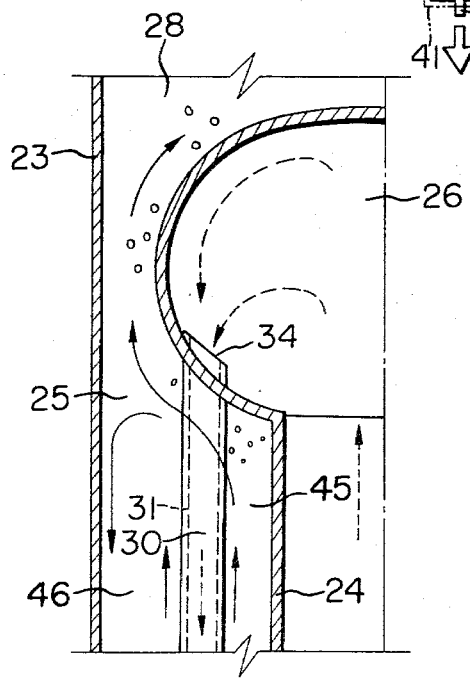
FIG. 9 is an enlarged longitudinal sectional view of the left side of the upper part of the apparatus shown in FIG. 3.

Further, as illustrated in FIGS. 7 and 8, heat receiving for the water jacket 45 of the intermediate water jacket 25 is performed through double-side system utilizing the inner shell 24 and the smoke pipes 30, while heat receiving for the water jacket 46 is performed through single-side system utilizing the smoke pipes 30 alone, and accordingly the water within the water jacket 45 comes to have a high temperature relative to the water within the water jacket 46, so that there is generated a self-convection such that the water in the former water jacket ascends while the water in the latter water jacket descends. Due to this self-convection, deposition of scales on the wall surfaces is hard to take place.

Also, at the time when the water flows into the water jacket 45 from the water jacket 46 by way of the interspaces C of the smoke pipes 30 illustrated in FIG. 8 by virtue of the self-convection, the scales are let to precipitate within the water jacket 46 toward the bottom of the water jacket 29 through the smoke pipes 30, whereby clean water is sent in the water jacket 45. Further, any scale passing through fine interspaces C and entering the lower part of the inner shell deposits in the upper part of the lower enlarged flue chamber 27.

As the foregoing apparatus is, as described above, free from deposition of scales on the high-temperature portions thereof prone to cause crack by superheating attributable to such deposition of scales, and the portions whereon scales deposit are always low-temperature portions thereof, there is no fear of its giving rise to any local superheating combustion loss due to deposition of scales.

Next, inasmuch as the outer wall faces of the upper and lower enlarged flue chambers 26 and 27 have spherical configurations with no obstacles to the ascent of air bubbles, they are free from adhesion of air bubbles thereto and, accordingly, occurrence of corrosion of these chambers, which entails leakage of water, owing to oxygen concentration cells resulting from adhesion of air bubbles can be prevented. Besides, by virtue of heating the exhaust gas, which is sent into the lower enlarged flue chamber 27 through the smoke pipe outlets 35, with the radiant heat emitted from the bottom plate 43 and discharging this exhaust gas as dry air, deposition of dews on the walls of cool water jackets due to low-temperature exhaust gas can be prevented, and further the dews arising from the suspension of operation of the combustor, etc. are discharged to the outside of the apparatus through the drain tube 40 disposed in the center of the bottom of the lower enlarged flue chamber 27. Accordingly, all the portions of the apparatus are free from adhesion or stay of dews thereon, and occurrence of corrosion attributable to dews can be prevented. The aforedescribed embodiment is only one instance, and of course it will do to replace each member thereof with some other member having identical functions.

An apparatus according to the present invention and of construction similar to the example described above, has a wide range of application to a variety of water heaters, for example, instantaneous water heaters for domestic use, boilers and waste heat recovering devices for industrial use, etc. It is very effective in economizing energies and resources. The liquid for use in the present invention will normally be water, but the apparatus may be used for heating any other liquid.

What is claimed is:

1. A liquid heating apparatus comprising a cylindrical outer shell provided with an outlet and an inlet, in which an inner shell consisting of a cylindrical body whose upper and lower portions are respectively provided with an enlarged flue chamber having a cross-sectional area remarkably larger than that of said cylindrical body is installed within said outer shell by leaving a space between the two shells so as to form a water jacket therebetween, a fire chamber is formed by closing said cylindrical body at above said lower enlarged flue chamber, an insert hole for burner which penetrates said inner and outer shells and opens into said fire chamber is provided, a rising heated gas chamber communicating with said fire chamber as well as upper enlarged flue chamber is formed above the fire chamber, a falling heated gas space is formed by intercommunicating said upper and lower enlarged flue chambers by means of plural smoke pipes penetrating the water jacket formed in between said outer and inner shells, and a flue outlet is provided for said lower enlarged flue chamber.

2. A liquid heating apparatus according to claim 1, wherein said upper and lower enlarged flue chambers are provided with part-spherical surface.

3. A liquid heating apparatus according to claim 2, wherein said lower enlarged flue chamber is provided with a drain tube disposed in the center of the bottom thereof.

4. A liquid heating apparatus according to claim 1, wherein said fine chamber has its surrounding wall as well as bottom wall built of refractory materials.

5. A liquid heating apparatus according to claim 4, wherein a heat radiating plate is provided on the lower side of the bottom wall of said fire chamber, to wit, on the top of said lower enlarged flue chamber.

* * * * *

UNITED STATES PATENT AND TRADEMARK OFFICE

CERTIFICATE OF CORRECTION

PATENT NO. : 4 280 450

DATED : July 28, 1981

INVENTOR(S) : Noboru Maruyama

It is certified that error appears in the above—identified patent and that said Letters Patent is hereby corrected as shown below:

Col. 8, line 1; change "fine" to ---fire---.

Signed and Sealed this

*Eighth* Day of *December 1981*

[SEAL]

*Attest:*

GERALD J. MOSSINGHOFF

*Attesting Officer*

*Commissioner of Patents and Trademarks*